US008167051B2

(12) United States Patent
Eddison et al.

(10) Patent No.: US 8,167,051 B2
(45) Date of Patent: May 1, 2012

(54) SELECTIVE AGITATION

(75) Inventors: Alan Martyn Eddison, York (GB); David Coull, Montrose (GB)

(73) Assignee: National Oilwell Varco, L.P., Houston, TX (US)

( * ) Notice: Subject to any disclaimer, the term of this patent is extended or adjusted under 35 U.S.C. 154(b) by 321 days.

(21) Appl. No.: 12/307,416

(22) PCT Filed: Jul. 6, 2007

(86) PCT No.: PCT/GB2007/002553

§ 371 (c)(1),
(2), (4) Date: May 8, 2009

(87) PCT Pub. No.: WO2008/007066

PCT Pub. Date: Jan. 17, 2008

(65) Prior Publication Data

US 2009/0223676 A1 Sep. 10, 2009

(30) Foreign Application Priority Data

Jul. 8, 2006 (GB) ..... 0613637.8

(51) Int. Cl.
*E21B 4/14* (2006.01)

(52) U.S. Cl. ..... 166/381; 166/319; 166/177.7; 175/296

(58) Field of Classification Search ..... 166/381, 166/316, 319, 177.7; 175/296, 107
See application file for complete search history.

(56) References Cited

U.S. PATENT DOCUMENTS

| | | | |
|---|---|---|---|
| 2,069,645 | A | 2/1937 | Cardew |
| 2,743,083 | A | 4/1956 | Zublin |
| 2,746,721 | A | 5/1956 | Moore |
| 2,348,047 | A | 2/1957 | Bielstein |
| 2,781,774 | A | 2/1957 | Baker et al. |
| 2,855,952 | A | 10/1958 | Tausch et al. |
| 2,920,764 | A | 1/1960 | Hodges |
| 3,051,246 | A | 8/1962 | Clark, Jr. et al. |
| 3,054,420 | A | 9/1962 | Williams |
| 3,199,532 | A | 8/1965 | Trick |
| 3,385,372 | A | 5/1968 | Knox |

(Continued)

FOREIGN PATENT DOCUMENTS

WO 2006/016137 A1 2/2006

OTHER PUBLICATIONS

EPO, Internal Search Report and Written Opinion, Intl. App. No. PCT/GB2007/002553, Mail dated Oct. 11, 2007, 8 pages.

(Continued)

*Primary Examiner* — Nicole Coy
(74) *Attorney, Agent, or Firm* — Jeffery Daly; JL Salazar Law Firm

(57) ABSTRACT

A fluid actuated downhole tool for inducing movement of a downhole apparatus is described. The tool comprises a body for coupling to downhole apparatus, the body being adapted to accommodate now of fluid therethrough and including a flow-modifying arrangement for modifying the flow of fluid through the body. The flow-modifying arrangement is configurable in an inactive configuration and in an active configuration. The fluid activated tool is selectively operated from the surface by varying an operating condition which causes the flow through the tool to either bypass or flow through the flow-modifying arrangement to induce movement of the downhole apparatus.

40 Claims, 3 Drawing Sheets

U.S. PATENT DOCUMENTS

| | | | | |
|---|---|---|---|---|
| 3,481,397 | A | 12/1969 | Baker | |
| 3,504,697 | A | 4/1970 | Colgan | |
| 3,640,351 | A | 2/1972 | Coyne et al. | |
| 3,894,818 | A | 7/1975 | Tschirky | |
| 3,899,033 | A | 8/1975 | Van Huisen | |
| 3,933,209 | A | 1/1976 | Sweeney | |
| 3,941,196 | A | 3/1976 | Curington et al. | |
| 4,040,488 | A | 8/1977 | Nelson | |
| 4,142,549 | A | 3/1979 | Autry | |
| 4,187,918 | A | 2/1980 | Clark | |
| 4,275,795 | A * | 6/1981 | Beimgraben et al. | 175/26 |
| 4,280,524 | A * | 7/1981 | Beimgraben | 137/268 |
| 4,291,723 | A | 9/1981 | Beimbraben et al. | |
| 4,401,171 | A | 8/1983 | Fuchs | |
| 4,457,221 | A | 7/1984 | Geren | |
| 4,474,241 | A | 10/1984 | Freeman | |
| 4,481,973 | A | 11/1984 | O'Brien et al. | |
| 4,487,221 | A | 12/1984 | Zwart | |
| 4,615,399 | A | 10/1986 | Schoeffler | |
| 4,729,432 | A | 3/1988 | Helms | |
| 4,819,745 | A | 4/1989 | Walter | |
| 4,830,122 | A | 5/1989 | Walter | |
| 4,953,595 | A | 9/1990 | Kotlyar | |
| 4,979,577 | A | 12/1990 | Walter | |
| 5,009,272 | A * | 4/1991 | Walter | 175/56 |
| 5,048,622 | A | 9/1991 | Ide | |
| 5,174,392 | A * | 12/1992 | Reinhardt | 175/107 |
| 5,190,114 | A | 3/1993 | Walter | |
| 5,320,181 | A | 6/1994 | Lantier, Sr. et al. | |
| 5,411,049 | A | 5/1995 | Colvard | |
| 5,472,053 | A | 12/1995 | Sullaway et al. | |
| 5,662,180 | A | 9/1997 | Coffman et al. | |
| 5,690,177 | A | 11/1997 | Budde | |
| 6,279,670 | B1 * | 8/2001 | Eddison et al. | 175/107 |
| 6,439,318 | B1 * | 8/2002 | Eddison et al. | 175/57 |
| 6,508,317 | B2 * | 1/2003 | Eddison et al. | 175/107 |
| 6,547,007 | B2 | 4/2003 | Szarka et al. | |
| 6,588,518 | B2 | 7/2003 | Eddison | |
| 6,666,273 | B2 | 12/2003 | Laurel | |
| 7,086,486 | B2 | 8/2006 | Ravensbergen et al. | |
| 7,523,792 | B2 * | 4/2009 | El-Rayes et al. | 175/92 |
| 7,726,418 | B2 | 6/2010 | Ayling | |
| 7,766,084 | B2 | 8/2010 | Churchill | |
| 2004/0129423 | A1 | 7/2004 | Eddison | |
| 2005/0211471 | A1 | 9/2005 | Zupanick | |
| 2007/0187112 | A1 * | 8/2007 | Eddison et al. | 166/380 |
| 2008/0029268 | A1 * | 2/2008 | Macfarlane | 166/311 |
| 2009/0032261 | A1 | 2/2009 | Eddison | |
| 2009/0104021 | A1 * | 4/2009 | Draeger et al. | 415/145 |
| 2009/0205838 | A1 | 8/2009 | Springett | |
| 2010/0276204 | A1 | 11/2010 | Connell | |

OTHER PUBLICATIONS

EPO, Preliminary Report on Patentability, Intl. App. No. PCT/GB2007/002553, dated Dec. 8, 2008, 5 pages.

EPO Claim Amendment after Search Report, Intl. App. No. 07733494.4, dated Mar. 27, 2009, 7 pages.

EPO, Office Action, Intl. App. No. 07 733 494.4-1266, dated Sep. 23, 2009, 4 pages.

EPO, Response to Office Action, Intl. App. No. 07733494.4, dated May 14, 2010, 2 pages.

EPO, Office Action, Intl. App. No. 07 733 494.4-1266, dated Dec. 29, 2010, 3 pages.

EPO, Response to Office Action, Intl. App. No. 07733494.4, dated Mar. 22, 2011, 1 page.

EPO, Examination Report, EP Patent Application No. 07 733 494.4, Sep. 23, 2009, pp. 1-3.

* cited by examiner

SELECTIVE AGITATION

FIELD OF THE INVENTION

This invention relates to an apparatus and method for use in the selective agitation of downhole apparatus. In particular, but not exclusively, the invention relates to the selective agitation of a drill string or a portion of a drill string, and the selective agitation of a bottom hole assembly (BHA).

BACKGROUND OF THE INVENTION

In the oil and gas industry, bores are drilled to access sub-surface hydrocarbon-bearing formations. Conventional drilling involves imparting rotation to a drill string at surface, which rotation is transferred to a drill bit mounted on a bottom hole assembly (BHA) at the distal end of the string. However, in directional drilling a downhole drilling motor may be used to impart rotation to the drill bit. In such situations it tends to be more difficult to advance the non-rotating drill string through the drilled bore than is the case when the entire length of drill string is rotating. The applicant supplies an apparatus, under the AG-itator trade mark, which may be utilised to induce vibration or movement to parts of a drill string, and which apparatus has been found to increase the rate of progress (ROP) of drill bits during some directional drilling operations. Features of this apparatus and other tools capable of inducing vibration or agitation may be found in applicant's U.S. Pat. Nos. 6,279,670, 6,508,317 and 6,439,318 the disclosures of which are incorporated herein by reference.

Applicant's AG-itator apparatus includes a Moineau principle positive displacement motor (PDM). As drilling fluid pumped through the drill string drives the motor, the motor stator drives a valve arrangement to vary the flow of fluid through the lower end of the drill string. The varying or pulsing fluid flow acts on a shock-sub which tends to extend and retract in response to the pressure variations in the fluid in the string resulting from the operation of the valve.

SUMMARY OF THE INVENTION

According to the present invention there is provided a method of inducing movement in downhole apparatus, the method comprising:

pumping fluid through a downhole support having a fluid actuated tool and a downhole apparatus mounted thereon; and selectively activating the fluid actuated tool to induce movement of the downhole apparatus.

According to another aspect of the invention there is provided a fluid actuated downhole tool for inducing movement of a downhole apparatus, the tool comprising: a body for coupling to downhole apparatus, the body being adapted to accommodate flow of fluid therethrough and including a flow-modifying arrangement for modifying the flow of fluid through the body to induce movement of the apparatus, the flow-modifying arrangement being configurable in an inactive configuration and in an active configuration.

The downhole apparatus may be a BHA, a drill string, part of a drill string, or another downhole support or tubular, such as coil tubing or a casing string.

In use, embodiments of the invention allow fluid to be passed through a downhole support, such as a drill string, without inducing movement of the drill string or of apparatus mounted on the string. However, when desired, the flow modifying arrangement of the fluid actuated tool may be configured or activated such that the flow of fluid induces movement of the downhole apparatus. This may be useful in a number of situations, for example at stages in certain drilling operations it may be desirable to agitate the BHA while at other times it may be desirable to avoid movement or agitation of the BHA.

Furthermore, an agitating tool will create a flow restriction and an associated pressure drop in the drill string. In some, but not all cases, it may be possible to accommodate this pressure drop by providing a higher fluid pressure above the tool. Additionally, some agitators can only accommodate a limited flow rate or pressure of fluid and thus the presence of an agitator in the string may limit the flow rate or pressure of fluid which may be pumped through the string. Embodiments of the invention may feature a flow diverter which selectively diverts flow around the flow-modifying arrangement such that the arrangement is not actuated, and the pressure drop normally associated with the operation of the arrangement is avoided. Other embodiments feature arrangements which include parts or portions which may be moved between operative and non-operative configurations. Thus, it may be possible to configure the downhole tool such that the pressure drop or limitations apparent when the tool is operating are avoided or at least minimised when the tool is in the inactive configuration.

Inducing movement or agitation in a drill string may also only be desirable in certain limited circumstances during a drilling operation. For example, if a drill string experiences differential sticking, inducing movement of the BHA or distal end of the string may be useful in freeing the string. To this end, it is known to include jars in drill strings for use in overcoming differential sticking, though the operation of a jar requires some time and only produces a single large impulse or shock. In contrast, embodiments of the present invention may be activated and actuated relatively quickly and it is believed the resulting agitation or vibration is more effective in freeing a differentially stuck string than the operation of a jar alone. Also, where a flow modifying arrangement is being utilised, this will induce pressure variations in the return flow of fluid in the annulus and may result in the annulus pressure falling below or close to the formation pressure, thus reducing or negating the difference in pressure between the annulus and formation which induced the differential sticking. Of course embodiments of the present invention may be provided in conjunction with a jar.

A plurality of fluid actuated tools in accordance with embodiments of the invention may be provided in a drill string. The tools may be adapted to be activated in unison, or may be activated and deactivated individually. Thus, movement of selected parts of a string may be induced, which may be useful where a particular section of the string is differentially stuck.

The downhole tool may take any appropriate form. In one embodiment, the tool includes a valve arrangement for use in modifying fluid flow. The valve arrangement may include relatively movable cooperating valve members. The valve members may move relative to one another in any appropriate manner, for example axially, laterally, or may rotate. In one embodiment the valve members are in the form of valve plates or members which are relatively rotatable and laterally movable. Activation and deactivation of the tool may be achieved by modifying the valve arrangement. The valve arrangement may be inactivated by fixing or otherwise retaining valve members relative to one another, typically in an open configuration by translating one or more valve members to non-operative positions, for example axially separating valve members, or by arranging for bypass of the valve arrangement.

Alternatively, or in addition, the tool may include a drive arrangement for driving the valve arrangement, and removing or decoupling drive from the valve arrangement may inactivate the tool. The drive arrangement may be fluid actuated, and the tool may be activated by directing fluid flow through the drive arrangement, and inactivated by bypassing the drive arrangement. This offers the advantage that pressure losses and wear and tear associated with the operation of the drive arrangement are avoided while the tool is inactive. Also, any limitations of the drive arrangement, for example pressure or flow rate restrictions, may be ignored while the tool is inactive, providing the operator with greater freedom and not placing restrictions on other operations. The drive arrangement may take any appropriate form, and may be a positive displacement motor (PDM), such as a Moineau principle motor. Where the drive arrangement includes a rotor or other moving part and a stator or other stationary part, the rotor may be translated relative to the stator to inactivate or render inoperative one or both of the drive arrangement and the valve arrangement. For example, axial movement of a rotor relative to a stator may inactivate the motor. If a valve member is coupled to the rotor, movement of the rotor relative to the stator may inactivate the valve arrangement. In a Moineau principle motor, axial movement of the rotor may be utilised to create an open axial flow path through the motor, such that the motor does not operate. Alternatively, in a Moineau principle motor with a valve member mounted to the rotor, limited axial movement of the rotor may render the valve arrangement inoperative, but may still result in rotation of the rotor. Movement of the rotor to an inoperative position may be induced by application of mechanical force, for example tension or weight, or by fluid pressure, which fluid pressure may be flow-related or may be a differential pressure between the interior of the tool and the surrounding annulus. One advantage of continuing to direct fluid through one or both of an inoperative or inactive drive arrangement and a valve arrangement is that this avoids the requirement to accommodate bypass flow within the tool body. Thus, the drive arrangement may occupy a larger cross-section and may be able to handle higher pressures and flow rates, and provide movement or vibrations of greater magnitude.

In other embodiments the drive arrangement may be omitted, for example an unstable valve arrangement may be provided which is adapted to shuttle or change configuration in certain conditions, for example when exposed to selected flow rates or pressures. When exposed to other conditions, the valve arrangement may assume a stable or inactive configuration. In one embodiment the fluid flow rates and pressures associated with normal drilling operations will maintain the valve arrangement in a stable open configuration. However, at a predetermined lower flow rate and pressure the valve assumes an unstable position and shuttles between the open and closed configurations.

Where the tool includes a bypass arrangement this may take any appropriate form. The bypass arrangement may include a bypass valve, which may be configured to, for example, direct fluid away from a flow modifying valve arrangement or a drive arrangement and through a bypass conduit. The bypass arrangement may be actuated by any appropriate means, and in certain embodiments is fluid pressure actuated, but may alternatively be actuated by mechanical force, for example by tension or weight.

The tool may be normally active, or normally inactive, and may be configured such that the tool maintains the desired, normal configuration during selected operational conditions, for example while the tool experiences the pressures and flow rates associated with normal drilling operations. However, if selected parameters change, for example the fluid flow rate or pressure increases, the tool may be adapted to assume the alternative configuration. In another embodiment, in a drilling application, the tool will be normally inactive when the tool is in compression, associated with weight being applied through the string from surface to the drill bit. However, if tension is applied to the string and the tool, associated with tension being applied to overcome a differential sticking problem, a predetermined tension may result in the tool assuming the active configuration, such that the drill string may be agitated while tension is applied from surface. The tool may be biased to assume the normal configuration by a spring.

The tool may be provided in combination with a fluid pressure-responsive tool, such as a shock tool. Thus, changes in the flow through the tool induce changes in the fluid-pressure responsive tool which may, for example, tend to axially extend and contract in response to changes in fluid pressure. The changes in the fluid responsive-tool may induce vibration or agitation of the associated downhole apparatus. In certain applications the presence of a fluid pressure-responsive tool may provide an enhanced agitation effect. The fluid pressure responsive tool may also be coupled or otherwise associated with one or both of a valve arrangement and a drive arrangement, whereby application of tension to the fluid pressure responsive tool may alter the configuration of a valve arrangement or drive arrangement, or may direct fluid to bypass one or both of the valve and drive arrangements. However, in certain downhole applications, for example where the downhole apparatus is coil tubing-mounted, the fluid pressure-responsive tool may be omitted: the relatively flexible coil tubing will itself tend to extend and contract on exposure to varying pressure.

BRIEF DESCRIPTION OF THE DRAWINGS

These and other aspects of the invention will now be described, by way of example, with reference to the accompanying drawings, in which.

DETAILED DESCRIPTION OF THE DRAWINGS

Figure 1:
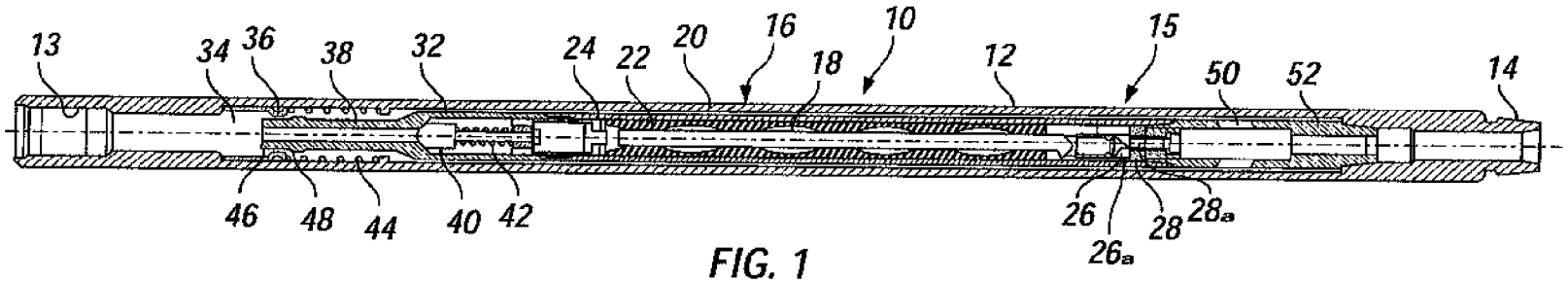
FIGS. 1, 2 and 3 are sectional drawings of a downhole tool for inducing movement of a downhole apparatus in accordance with a first embodiment of the present invention.
Figure 2:
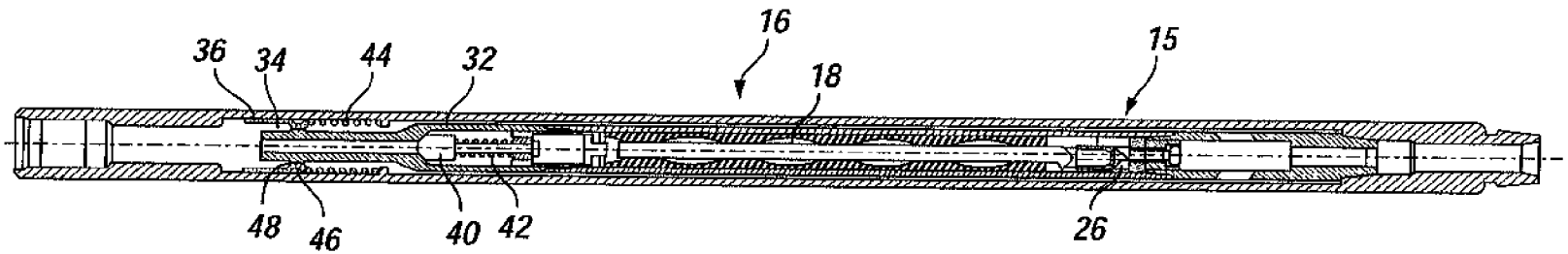
Figure 3:
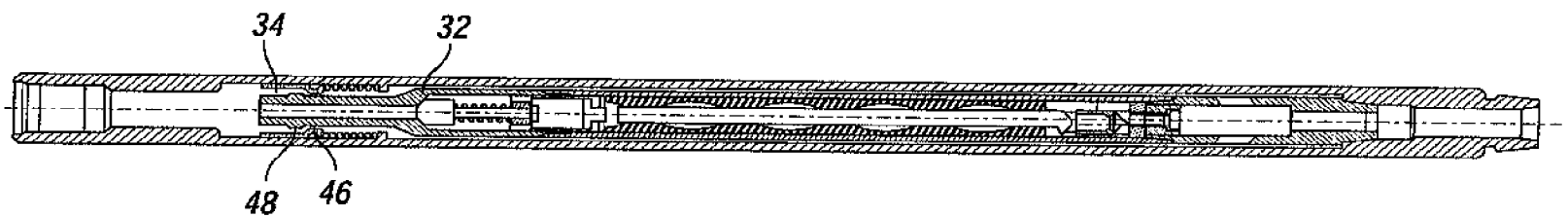

Reference is first made to FIGS. 1, 2 and 3 of the drawings, which are sectional drawings of a fluid actuated downhole tool 10 for inducing movement of a downhole apparatus in accordance with a first embodiment of the present invention. The tool 10 is adapted to be incorporated in a drilling fluid transmitting drill string and thus includes a generally cylindrical hollow body 12 featuring conventional pin and box connections 14, 13 at the lower and upper ends of the body.

As noted above, the tool 10 is adapted to permit passage of drilling fluid and, as will be described, in selected tool configurations fluid may pass through the tool 10 without actuating the tool. However, in an alternative configuration the drilling fluid is directed through the tool 10 to actuate the tool 10, creating pressure pulses in the drilling fluid which may be utilised to agitate or vibrate the tool string to, for example, overcome differential sticking problems.

The tool 10 comprises a drilling fluid-flow modifying valve 15 and an associated drive motor 16, both accommodated within a central portion of the tool body 12. The motor is Moineau principle positive displace motor comprising a central rotor 18 which rotates within a stator 20 comprising a profiled elastomeric stator body 22 located within a metallic tubular stator housing 24. The lower end of the rotor 18 extends beyond the stator 20 and provides mounting for a moveable valve member 26 which co-operates with a fixed valve member 28. When the motor 16 is operating, the rotor 18 rotates and also moves transversely, and this movement is transferred to the rotor-mounted valve member 26. The movement of the valve member 26 moves the respective valve openings 26*a*, 28*a* into and out of alignment, to vary the open flow area defined by the valve 15. This is similar to the arrangement described in applicant's U.S. Pat. No. 6,279,670, the disclosure of which is incorporated herein by reference.

The motor 16 does not occupy all of the area defined within the tool body 12, and an annular bypass passage 32 is provided between the stator housing 24 and the tool body 12. A bypass passage inlet 34 is formed between a bypass control collar 36, which is spring mounted on the tool body 12, and a tubular stator extension 38 provided on the upper end of the stator housing 24. Fluid passage through the tubular extension 38, and into the motor 16, is also controlled, in part, by a valve 40 provided within the stator extension 38. A light spring 42 normally maintains the valve 40 in the closed position.

As noted above, the collar 36 is mounted in the tool body 12, and is normally biased towards an upper position by a spring 44. The lower end of the collar 36 defines an inwardly extending lip 46. The outer diameter of the extension 38 also defines a lip 48, and when the lips 46, 48 are aligned, as shown in FIG. 2 of the drawings, flow through the bypass passage inlet 34 is restricted, and thus the drilling fluid flow will be directed through the motor 16.

The collar 36 is configured such that, in the absence of any through flow, or in the presence of a flow rate through the tool 10 up to a predetermined level, the spring 44 maintains the collar in an upper position, with the collar lip 46 located above and spaced from the extension lip 48, as illustrated in FIG. 1. However, with an elevated flow rate, the pressure differential across the collar 36 increases, and the collar 36 is pushed downwardly, against the action of the spring 44, to locate the lips 46, 48 directly adjacent one another, so as to restrict the passage of fluid into the bypass passage 32, as illustrated in FIG. 2. This would normally be the stop position for the collar 36. However, in certain embodiments, a still further increase in flow rate will push the collar 36 to a lower position in which the collar lip 46 is located spaced from and below the stator extension lip 48, allowing fluid to flow through the bypass passage 32 once more, as illustrated in FIG. 3.

A bypass passage outlet 50 is defined by lateral passages formed in a tubular support 52 which mounts the motor 16 to the body 12.

In use, the tool 10 is incorporated in a drill string at an appropriate location, typically just above the BHA, and below a shock tool. When the drilling fluid pumps are running up to and at their normal operational pressure, the bypass control collar 36 is located as illustrated in FIG. 1 to open the bypass inlet 34, such that drilling fluid may flow through the bypass passage 32. Thus, the drilling fluid does not pass through the motor 16, and there is no agitation produced.

However, if the pump pressure is increased, the pressure differential created across the collar 36 also increases and the collar 36 is pushed downward, against the action of the spring 44, to align the lips 46, 48, and substantially restrict access to the bypass passage 32. The motor valve 40 now experiences an elevated differential pressure, and thus opens (as illustrated in FIG. 2) to allow the drilling fluid to flow into and through the motor 16.

The flow of fluid through the motor 16 causes the rotor 18 to rotate and thus drives the valve member 26, varying the open flow area defined by the valve 15. The resulting variation in flow area creates pressure pulses within the string, which pulses act on the shock tool provided in the string above the tool 10. The shock tool tends to extend and retract in response to the pulses. The combined effect of the pulsing fluid pressure in the string and the extension and retraction of the shock sub cause agitation and vibration of the string which may be utilised to, for example, assist in overcoming differential sticking problems.

When agitation of the string is no longer required, the flow of drilling fluid is decreased, such that the bypass control collar 36 moves upwards to misalign the lips 46, 48, allowing access to the bypass passage 32. The spring 42 then closes the motor valve 40, such that the drilling fluid will bypass the motor 16 once more, and drilling operations may continue in the absence of agitation.

Figure 4:
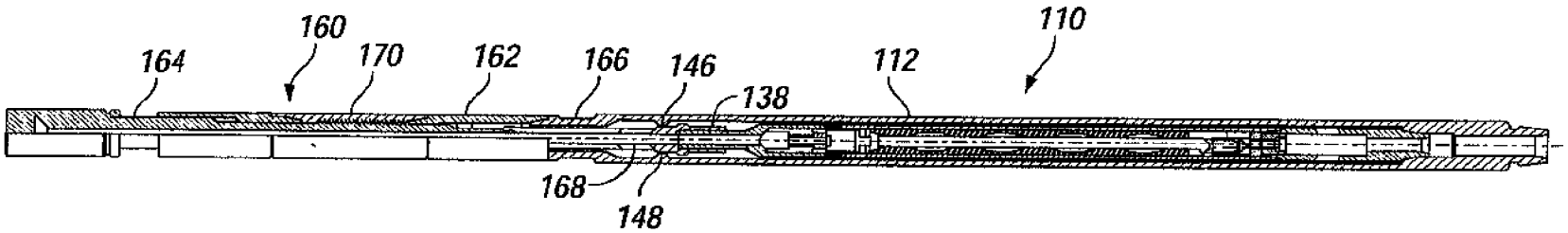
FIGS. 4, 5 and 6 are sectional drawings of a downhole tool for inducing movement of a downhole apparatus in accordance with a second embodiment of the present invention.
Figure 5:
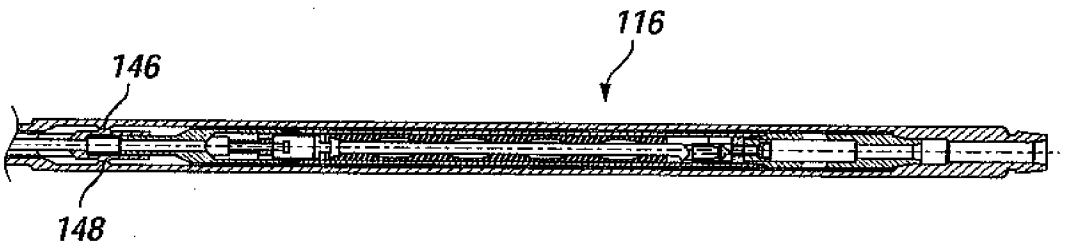
Figure 6:
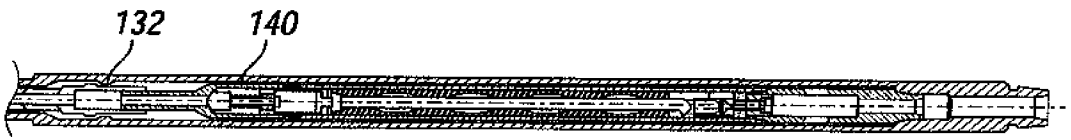

Reference is now made to FIGS. 4, 5 and 6 of the drawings, which illustrate a tool 110 in accordance with a second embodiment of the present invention. The tool 110 shares many features with the tool 10 described above, but is reconfigured, between an active or agitating configuration and an inactive or non-agitating configuration, by mechanical force, in particular by application of weight and tension.

FIG. 4 illustrates a shock tool 160, the shock tool female body portion 162 being fixed to the upper end of the tool body 112. The shock tool male body portion 164 is coupled to a sleeve 166 which is slidably coupled to the upper end of the stator extension 138.

In this embodiment, the tool body 112 defines the inwardly directed bypass control lips 146, whereas the stator extension 138 defines the outwardly directed lips 148. Lateral flow passages 168 are provided in the sleeve 166 above the lips 148.

In use, the tool 110 and shock tool 160 are incorporated in a drill string. During drilling, with weight being applied through the string to the bit, the shock tool 160 is compressed, compressing the spring 170 between the male and female shock tool portions 164, 162, such that the stator extension lips 148 are located spaced from and below the lips 146, as illustrated in FIG. 4. Thus, drilling fluid may pass through the shock sub, through the sleeve 166 and into the bypass passage 132 via the flow passages 168.

However, if tension is applied to the string, the shock tool 160 is axially extended and the male and female shock tool parts 164, 162 are moved relative to one another such that the lips 146, 148 are aligned. Fluid flow is thus now directed through the motor 116, to provide agitation. Still further tension may result in the tool 110 assuming the configuration as shown in FIG. 6, in which the bypass passage 132 is re-opened and the motor valve 140 closed.

Figure 7:
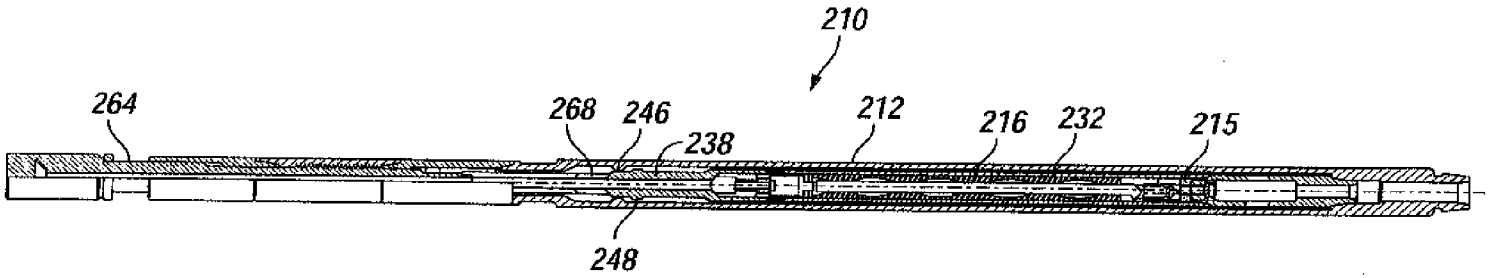
FIG. 7 is a sectional drawing of a downhole tool for inducing movement of a downhole apparatus in accordance with a third embodiment of the present invention.

Reference is now made to FIG. 7 of the drawings, which illustrates a tool 210 in accordance with a third embodiment of the present invention. This tool 210 shares many features with the above-described tool 110. However the operating parts of the tool 210 are not mounted directly to the tool body 212, but are rigidly coupled to the shock sub male body portion 264 by a stator extension 238 which defines lateral flow passages 268 and an outwardly extending lip 248. Thus, when weight is applied to a drill bit from surface via a drill string incorporating the tool 210, the motor 216 assumes the position within the tool body 212 as illustrated in FIG. 7, such that the drilling fluid may bypass the motor 216 and valve 215. However, if tension is applied to the string the bypass passage 232 is closed by the alignment of the lips 246, 248, and drilling fluid will be directed through the motor 216, and the valve 215 driven to provide vibration and agitation of the drill string.

Figure 8:
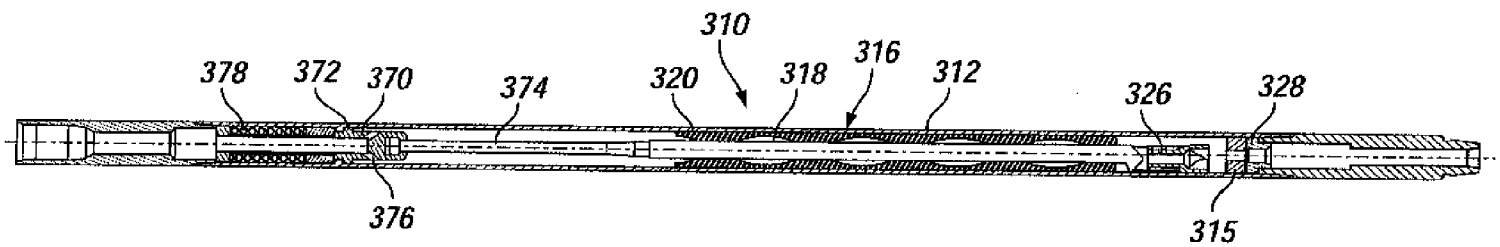
FIGS. 8 and 9 are sectional drawings of a downhole tool for inducing movement of a downhole apparatus in accordance with a fourth embodiment of the present invention.
Figure 9:
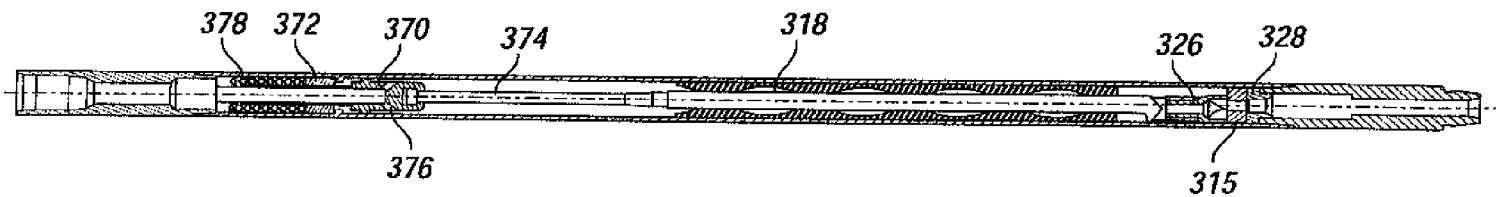

FIGS. 8 and 9 of the drawings illustrate a tool 310 in accordance with a fourth embodiment of the invention. In this tool 310 there is no provision for bypass of the motor 316. Rather, as will be described, the tool 310 is inactivated by separating the valve members 326, 328.

In the absence of a bypass passage, the tool body 312 also forms the motor body, allowing the tool 310 to incorporate a larger diameter motor 316, which motor 316 will accommodate large flow rates and larger pressure differentials.

The motor rotor 318 is axially movable within the stator 320, such that the valve members 326, 328 may be spaced apart, as illustrated in FIG. 8, or in an abutting, operative configuration, as shown in FIG. 9. Clearly, when the valve member 326, 328 are spaced apart, rotation of the movable valve member 326 will have no impact on the flow of drilling fluid through the tool 310.

Axial movement of the rotor 318 is achieved by operation of a fluid flow-actuated stator adjuster 370 located in an upper portion of the tool body 310. The adjuster 370 includes a flow sleeve 372 which is coupled to the rotor 318 by a stator extension 374, the coupling between the sleeve 372 and the extension 374 being adapted to accommodate the rotation and transverse movement of the rotor 318.

The lower end of the sleeve 372 defines restricted flow outlets 376, such that pumping drilling fluid through the sleeve 372 creates a downwardly directed differential fluid pressure force on the sleeve 372, which force is resisted by a compression spring 378 provided between the sleeve 372 and the tool body 312.

At lower flow rates, the spring 378 maintains the valve members 326, 328 in a spaced apart configuration, as illustrated in FIG. 8. The motor 316 is actuated by the flow of fluid through the string, however the corresponding rotation of the valve member 326 has no impact on the flow of fluid through the valve 315, such that there is no agitation of the string.

At higher flow rates, the sleeve 372 is pushed downwards such that the valve 315 assumes an operative configuration, as illustrated in FIG. 9. In this configuration, rotation of the valve member 326 varies the flow area through the valve 315, producing agitation of the drill string.

Thus, the operation of the tool 310, and thus the absence or presence of vibration or agitation, may be controlled merely by varying the rate at which drilling fluid is pumped through the drill string.

Thus, it will be apparent to the person of skill in the art that the various embodiments of the present invention descried above provide the operator with a convenient means of selectively agitating a drill string.

Those of skill in the art will also appreciate that the above-described embodiments are merely exemplary of the present invention and that various modifications and improvements may be made to these embodiments without departing from the scope of the invention. For example, tools made in accordance with embodiments of the invention could be used in other combinations with other tubing forms, such as coil tubing or a tool string.

The invention claimed is:

1. A method of inducing movement in a downhole apparatus, the method comprising:

pumping fluid through a downhole support having a fluid actuated downhole tool, and the downhole apparatus mounted thereon; and selectively activating the fluid activated downhole tool by varying an operating condition from the surface wherein the downhole tool comprises a body for coupling to the downhole apparatus, the body having a fluid bypass passage to accommodate flow of fluid therethrough and wherein the downhole tool further comprises a flow-modifying valve arrangement for modifying the flow of fluid through the body, such that in a first operating condition flow is bypassed around the flow-modifying valve arrangement and in a second operating condition flow is passed through the flow-modifying valve arrangement to the downhole apparatus to induce movement of the downhole apparatus.

2. A fluid actuated downhole tool for inducing movement of a downhole apparatus, the downhole tool comprising:

a body for coupling to the downhole apparatus, the body having a fluid bypass passage to accommodate flow of fluid therethrough and wherein the downhole tool further comprises a flow-modifying valve arrangement for modifying the flow of fluid through the body, such that in a first operating condition flow is bypassed around the flow-modifying valve arrangement and in a second operating condition flow is passed through the flow-modifying valve arrangement to the downhole apparatus to induce movement of the downhole apparatus, the flow-modifying valve arrangement being configurable in one of an inactive configuration and an active configuration and wherein the flow-modifying valve arrangement is activatable by varying an operating condition from the surface.

3. The fluid actuated downhole tool of claim 2, wherein the downhole apparatus is a BHA, a drill string, part of a drill string, or another downhole support or tubular, such as coil tubing or a casing string.

4. The fluid actuated downhole tool of claim 3, further comprising a flow diverter which selectively divert flow around the flow-modifying valve arrangement.

5. The fluid actuated downhole tool of claim 4, wherein the tool is associated with a jar.

6. The fluid actuated downhole tool of claim 2, wherein the flow-modifying valve arrangement includes relatively movable cooperating valve members.

7. The fluid actuated downhole tool of claim 6, wherein the valve members are adapted to move relative to one another in any appropriate manner.

8. The fluid actuated downhole tool of claim 7, wherein the valve members are in the form of valve plates or members which are relatively rotatable and laterally movable.

9. The fluid actuated downhole tool of claim 6, wherein the valve arrangement is inactivated by fixing or otherwise retaining valve members relative to one another.

10. The fluid actuated downhole tool of claim 6, wherein the valve arrangement is inactivated by moving to an open configuration.

11. The fluid actuated downhole tool of claim 10, wherein the valve arrangement is moved to the open configuration by translating one or more valve members to non-operative positions.

12. The fluid actuated downhole tool of claim 10, wherein the valve arrangement is inactivated by arranging for bypass of the valve arrangement.

13. The fluid actuated downhole tool of claim 12, wherein the tool includes a drive arrangement for driving the valve arrangement.

14. The fluid actuated downhole tool of claim 13, wherein removing or decoupling the drive arrangement from the valve arrangement inactivates the tool.

15. The fluid actuated downhole tool of claim 14, wherein the drive arrangement is fluid actuated, and the tool is activated by directing fluid flow through the drive arrangement, and inactivated by bypassing the drive arrangement.

16. The fluid actuated downhole tool of claim 15, wherein the drive arrangement is a positive displacement motor.

17. The fluid actuated downhole tool of claim 16, wherein the positive drive motor is a Moineau principle motor.

18. The fluid actuated downhole tool of claim 17, wherein the drive arrangement includes a rotor or other moving part and a stator or other stationary part.

19. The fluid actuated downhole tool of claim 18, wherein the rotor is translated relative to the stator to inactivate or render inoperative one or both of the drive arrangement and the valve arrangement.

20. The fluid actuated downhole tool of claim 19, wherein axial movement of the rotor relative to the stator inactivates the motor.

21. The fluid actuated downhole tool of claim 19, wherein movement of the rotor relative to the stator inactivates the valve arrangement.

22. The fluid actuated downhole tool of claim 18, wherein axial movement of the rotor is utilized to create an open axial flow path through the Moineau principle motor, such that the motor does not operate.

23. The fluid actuated downhole tool of claim 18, wherein limited axial movement of the rotor renders the valve arrangement inoperative.

24. The fluid actuated downhole tool of claim 23, wherein movement of the rotor to an inoperative position is induced by application of mechanical force.

25. The fluid actuated downhole tool of claim 24, wherein the mechanical force is tension or weight.

26. The fluid actuated downhole tool of claim 24, wherein the mechanical force is by fluid pressure, which fluid pressure is flow-related or is a differential pressure between the interior of the tool and the surrounding annulus.

27. The fluid actuated downhole tool of claim 12, wherein the bypass includes a bypass valve.

28. The fluid actuated downhole tool of claim 27, wherein the bypass valve is configured to direct fluid away from the flow modifying valve arrangement or the drive arrangement and through the fluid bypass passage.

29. The fluid actuated downhole tool of claim 28, wherein the bypass valve is fluid pressure actuated.

30. The fluid actuated downhole tool of claim 28, wherein the bypass valve is actuated by mechanical force.

31. The fluid actuated downhole tool of claim 30, wherein, in use, the tool is normally active, or normally inactive, and is configured such that the tool maintains the desired, normal configuration during selected operational conditions.

32. The fluid actuated downhole tool of claim 31, wherein, in use, the tool is adapted to assume an alternative configuration.

33. The fluid actuated downhole tool of claim 31, wherein, in use, the tool is normally inactive when the tool is in compression, associated with weight being applied through the string from a surface to the drill bit.

34. The fluid actuated downhole tool of claim 31, wherein, in use, a predetermined tension results in the tool assuming the active configuration, such that the drill string is agitated while tension is applied from surface.

35. The fluid actuated downhole tool of claim 34, wherein the tool is biased to assume a normal configuration by a spring.

36. The fluid actuated downhole tool of claim 35, wherein the tool is provided in combination with a fluid pressure-responsive tool, such as a shock tool.

37. The fluid actuated downhole tool of claim 36, wherein the fluid pressure-responsive tool is coupled or otherwise associated with one or both of the valve arrangement and a drive arrangement, whereby application of tension to the fluid pressure responsive tool alters the configuration of the valve arrangement or the drive arrangement, or direct fluid to bypass one or both of the valve and drive arrangements.

38. The fluid actuated downhole tool of claim 2, wherein the valve arrangement is adapted to shuttle or change configuration in certain conditions.

39. The fluid actuated downhole tool of claim 2 comprising a plurality of the fluid actuated downhole tools, wherein the tools are provided in a drill string.

40. The fluid actuated downhole tool of claim 39, wherein, in use, the tools are adapted to be activated in unison, or activated and deactivated individually.

* * * * *